US007994984B2

(12) United States Patent
Inoue et al.

(10) Patent No.: US 7,994,984 B2
(45) Date of Patent: Aug. 9, 2011

(54) ANTENNA APPARATUS

(75) Inventors: Kazuhiro Inoue, Tokyo (JP); Makoto Higaki, Kawasaki (JP); Shuichi Sekine, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 342 days.

(21) Appl. No.: 12/188,522

(22) Filed: Aug. 8, 2008

(65) Prior Publication Data

US 2009/0140929 A1 Jun. 4, 2009

(30) Foreign Application Priority Data

Nov. 30, 2007 (JP) ..... 2007-311069

(51) Int. Cl.
*H01Q 1/38* (2006.01)

(52) U.S. Cl. ..... 343/700 MS; 343/909

(58) Field of Classification Search ..... 343/700 MS, 343/846, 909

See application file for complete search history.

(56) References Cited

U.S. PATENT DOCUMENTS 6,262,495 B1 7/2001 Yablonovitch et al.
6,670,921 B2 * 12/2003 Sievenpiper et al. .. 343/700 MS
6,768,476 B2 7/2004 Lilly et al.
7,245,269 B2 * 7/2007 Sievenpiper et al. ..... 343/909
7,760,154 B2 * 7/2010 Sekine et al. ..... 343/795
2008/0150825 A1 6/2008 Higaki et al.
2009/0140929 A1 6/2009 Inoue et al.

FOREIGN PATENT DOCUMENTS

JP 3653470 3/2005

OTHER PUBLICATIONS

U.S. Appl. No. 12/623,749, filed Nov. 23, 2009, Inoue, et al.
U.S. Appl. No. 12/410,768, filed Mar. 25, 2009, Suetsuna, et al.
U.S. Appl. No. 12/170,733, filed Jul. 10, 2008, Shuichi Sekine et al.

* cited by examiner

*Primary Examiner* — Tan Ho
(74) *Attorney, Agent, or Firm* — Oblon, Spivak, McClelland, Maier & Neustadt, L.L.P.

(57) ABSTRACT

There is provided with an antenna apparatus, including: a finite ground plane; planar elements arranged along and on both sides of a first gap line or a second gap line that is orthogonal to the first gap line; first linear elements connecting the ground plane with the planar elements; an antenna element including a second linear element placed in the first or second gap line and a third linear element placed such that one end of it is connected to one end of the second linear element and an other end of it faces the ground plane; and a feeding point supplying electric power to the other end of the third linear element, wherein a connection point between the second and third linear elements is positioned in an intersection area of the first and second gap lines, and the feeding point is provided in a vicinity of an edge of the ground plane.

12 Claims, 14 Drawing Sheets

ANTENNA APPARATUS

CROSS REFERENCE TO RELATED APPLICATIONS

This application is based upon and claims the benefit of priority from the prior Japanese Patent Applications No. 2007-311069, filed on Nov. 30, 2007; the entire contents of which are incorporated herein by reference.

BACKGROUND OF THE INVENTION

1. Field of the Invention

The present invention relates to an antenna apparatus for a thin and small wireless device, for example, and more particularly, to a technique for arranging an antenna on a high-impedance substrate.

2. Related Art

An Electromagnetic Band Gap (EBG) substrate is known as a technique for arranging a metallic plate (or a ground plane) and an antenna in close proximity to each other for the purpose of making an antenna apparatus thin. An EBG substrate is structured by arranging planar elements in a matrix at a certain height over a metallic plate and connecting the planar elements with the metallic plate via linear elements. The EBG substrate realizes high impedance by creating LC parallel resonance circuits by way of distributed circuits and suppresses unnecessary current distribution that can be generated on the metallic plate.

However, since current locally distributes also on the EBG substrate, degradation of antenna characteristics occurs when the EBG substrate and the antenna are arranged very closely to each other. This is because current distribution on the antenna significantly varies due to an effect of current distributed on the EBG substrate, resulting in impossibility of matching. Meanwhile, a monopole antenna encounters a problem of an inability to make effective use of radiation from the ground plane, which is a characteristic of the monopole antenna, because current on the ground plane is suppressed.

Due to these facts, EBG substrates generally suppress degradation of antenna characteristics resulting from mutual coupling by not positioning the antenna and the EBG substrate very closely to each other. However, such a method imposes a limit on reducing the thickness of an antenna apparatus.

SUMMARY OF THE INVENTION

According to an aspect of the present invention, there is provided with an antenna apparatus, comprising:

a finite ground plane;

a plurality of first planar elements arranged along and on both sides of a first gap line or a second gap line that is orthogonal to the first gap line;

a plurality of first linear elements to connect the finite ground plane with each of the first planar elements;

an antenna element including a second linear element placed in the first or second gap line and a third linear element placed such that one end of the third linear element is connected to one end of the second linear element and an other end of the third linear element faces the finite ground plane; and a first feeding point to supply electric power to the antenna element from the other end of the third linear element, wherein a connection point of the second linear element with the third linear element is positioned in an intersection area of the first gap line and the second gap line, and the first feeding point is provided in a vicinity of an edge of the finite ground plane.

DETAILED DESCRIPTION OF THE INVENTION

First, an antenna apparatus using the EBG (Electromagnetic Band Gap) substrate which the present inventors had known before conceiving the present invention is described.

Figure 12:
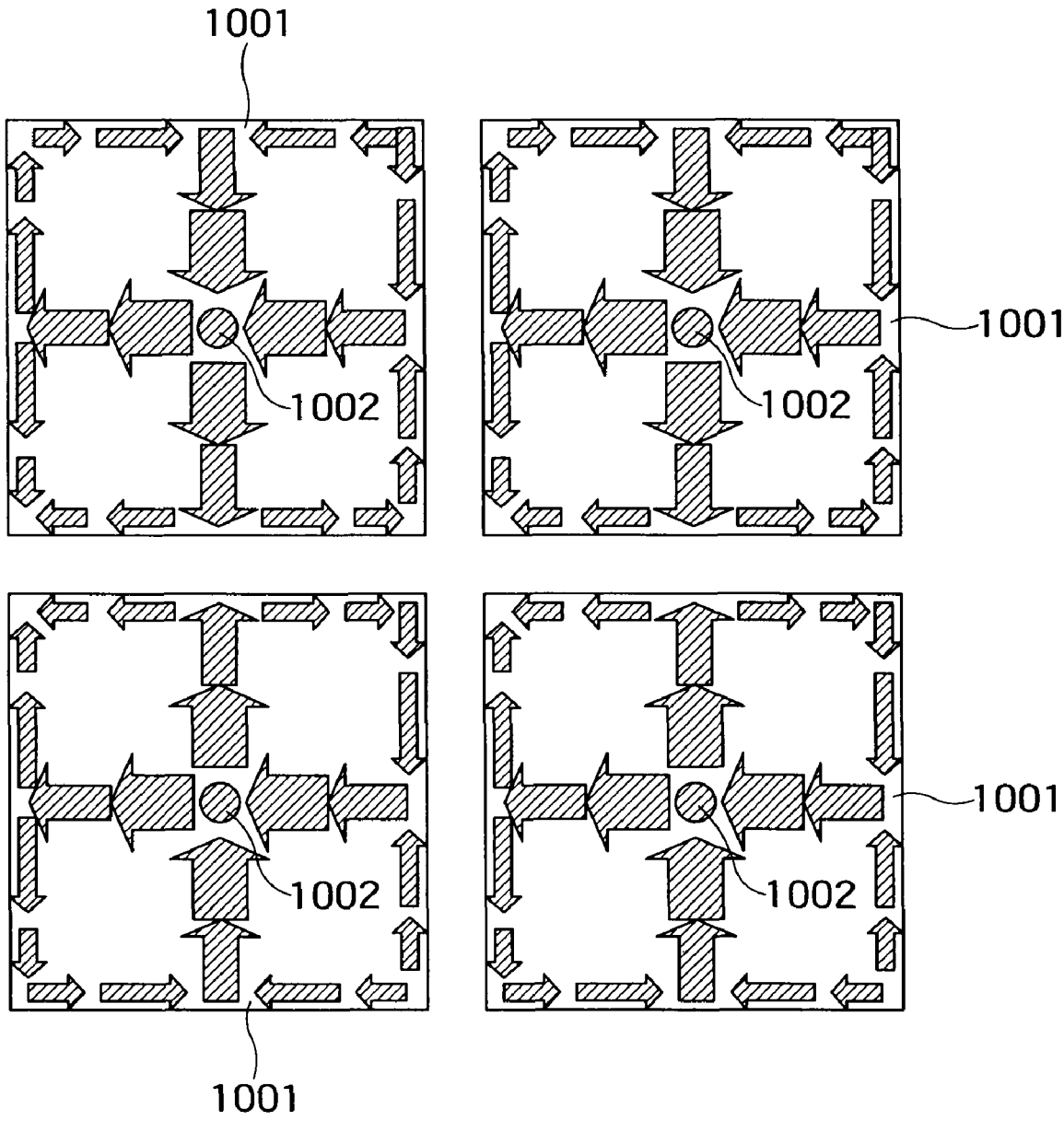
FIG. 12 shows current distribution on planar elements on an EBG substrate.

FIG. 12 shows current distribution on planar elements 1001 on an EBG substrate which has a plurality of planar elements 1001 arranged in an n×m (here 2×2) matrix.

The planar elements 1001 are connected with a ground plane via linear elements 1002 at their center.

It is understood that when in operation two currents that have opposite phases to each other flow toward the center of each side of the planar elements 1001 and a relatively strong current flows in the center of the planar elements 1001.

Figure 13:
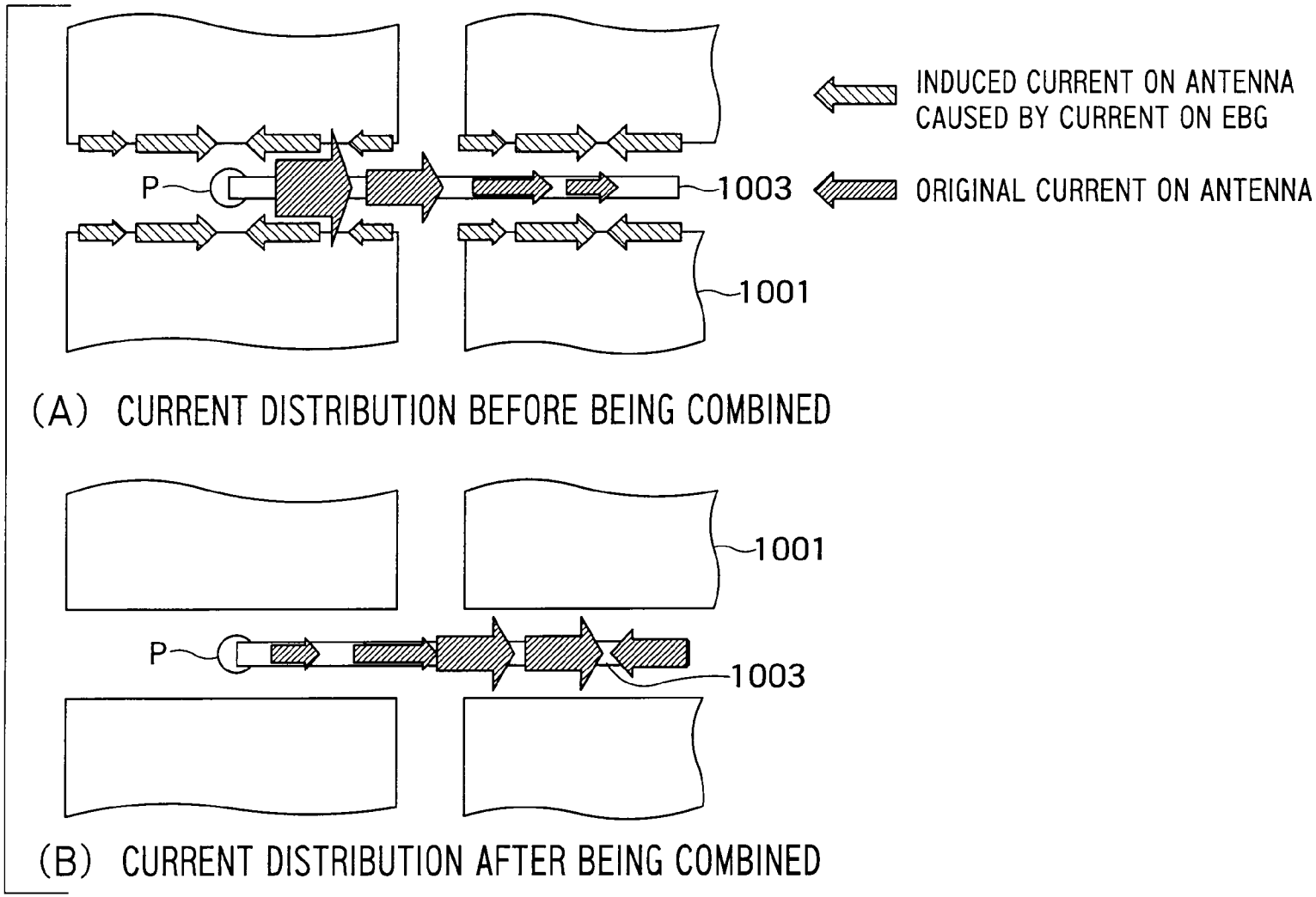
FIG. 13 shows an example of a known antenna apparatus using an EBG substrate.

FIG. 13 illustrates current distribution on a monopole antenna provided on an EBG substrate.

A monopole antenna 1003 is approximately L-shaped as a whole and includes a portion that is parallel with the ground plane and a portion that is perpendicular to the ground plate. An end of the perpendicular portion is connected to a feeding point "P". The portion parallel with the ground plane is placed in a gap line between planar elements 1001, which is considered to be relatively little affected by the current on the EBG substrate (currents on the planar elements). The feeding point "P" is provided on the ground plate beneath the gap line. To the feeding point "P", a high-frequency current is supplied from a feeder line not shown.

The current distribution shown in FIG. 13(A) separately illustrates distribution of an induced current that is generated on the monopole antenna 1003 due to the current on the EBG substrate (currents on the planar elements) and distribution of a current that originally exists on the monopole antenna 1003. FIG. 13(B) shows the current distribution as the sum of those currents, that is, distribution of a current that actually flows in the monopole antenna 1003 (a combined current).

As will be apparently understood from comparison of FIG. 13(A) with FIG. 13(B), the combined current on the monopole antenna 1003 has relatively largely changed from the originally existing current due to the effect of the current on the EBG substrate (currents on the planar elements). This is because while the current on the monopole antenna 1003 is either positive or negative, the current on the EBG substrate undergoes repeated reversal of positive and negative.

Change of antenna characteristics caused by such a current on the EBG substrate becomes more noticeable as the size of the planar elements is closer to a operating wavelength and poses a serious problem especially when the size of the planar elements is close to the operating wavelength. Meanwhile, when the size of the planar elements is very small compared to the operating wavelength, change of antenna characteristics is not so obvious and problematic. This is because when the size of the planar elements is small enough as compared with the operating wavelength, the interval of negative and positive reversal of current distribution on the EBG substrate is small and thus it is possible to consider that reversing currents cancel each other on the antenna.

Figure 14:
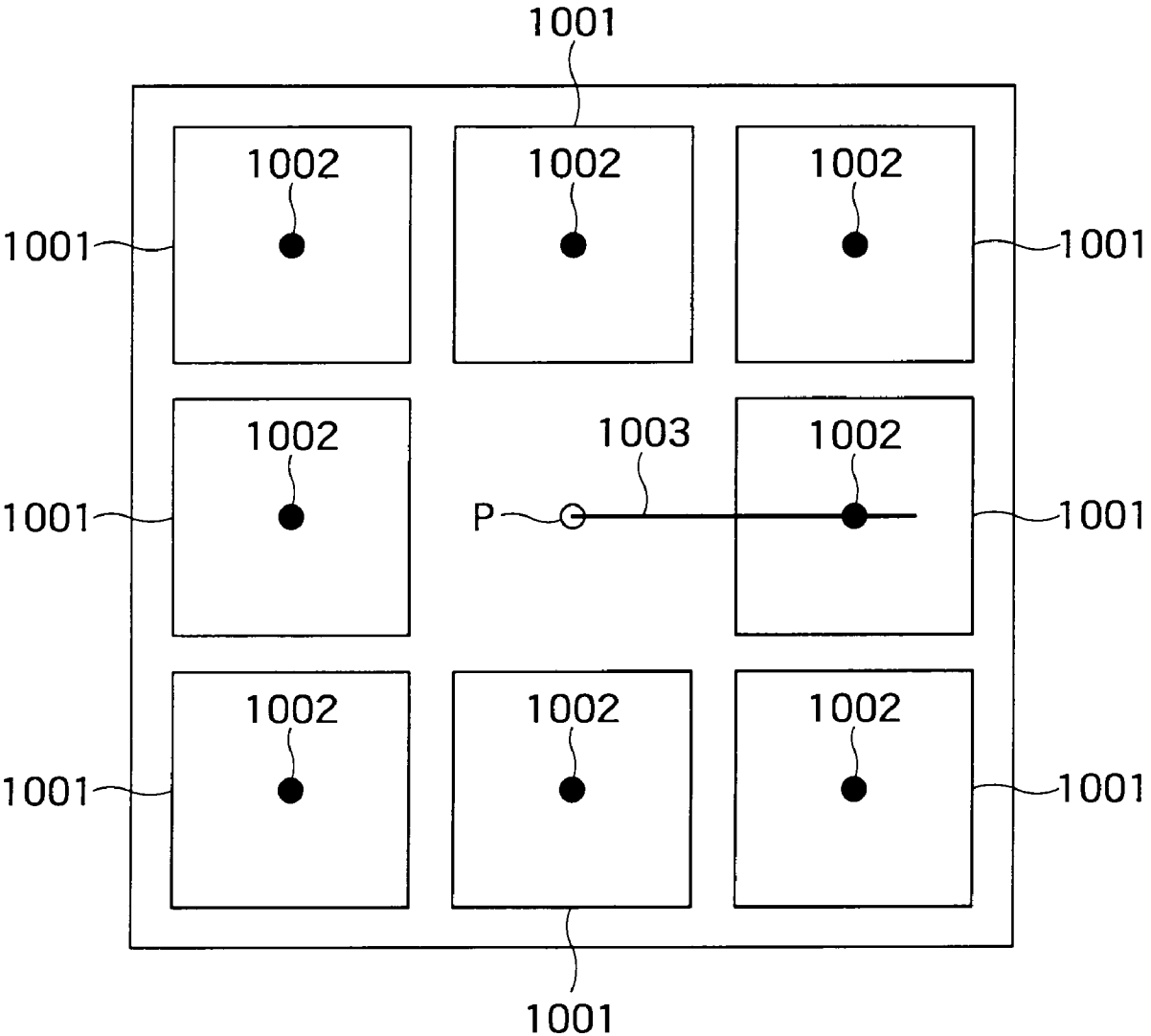
FIG. 14 shows another example of a know antenna apparatus using an EBG substrate.

FIG. 14 shows a case where one planar element 1001 and one linear element 1002 are removed from the EBG substrate and a monopole antenna is placed utilizing the open space. The feeding point "P" is positioned at the center of the EBG substrate.

Also in this configuration, as the size of the planar elements 1001 is closer to the operating wavelength, change of antenna characteristics resulting from the current on the EBG substrate becomes noticeable and poses a serious problem when the size of the planar elements 1001 is close to the operating wavelength, as in the configuration of FIG. 13. The configuration of FIG. 14 also has a problem of radio wave radiation from the ground plane, which is a characteristic of the monopole antenna, being suppressed and antenna characteristics being degraded.

Also, such a placement of the monopole antenna becomes a cause of hindering reduction of antenna apparatus thickness, which is a goal primarily pursued by the EBG substrate. This is because when the size of the planar elements 1001 on the EBG substrate is relatively large, unnecessary image current resulting from the current on the monopole antenna is induced in the area from which the planar element 1001 has been removed and thus the distance between the monopole antenna 1003 and the EBG substrate cannot be made very short.

The embodiments of the invention are intended to enable the monopole antenna to be positioned in proximity of the EBG substrate without degrading antenna characteristics as much as possible even when the size of the planar elements is large, thereby reducing the thickness of the antenna apparatus. The embodiments are described below in detail with reference to drawings.

First Embodiment

Figure 1:
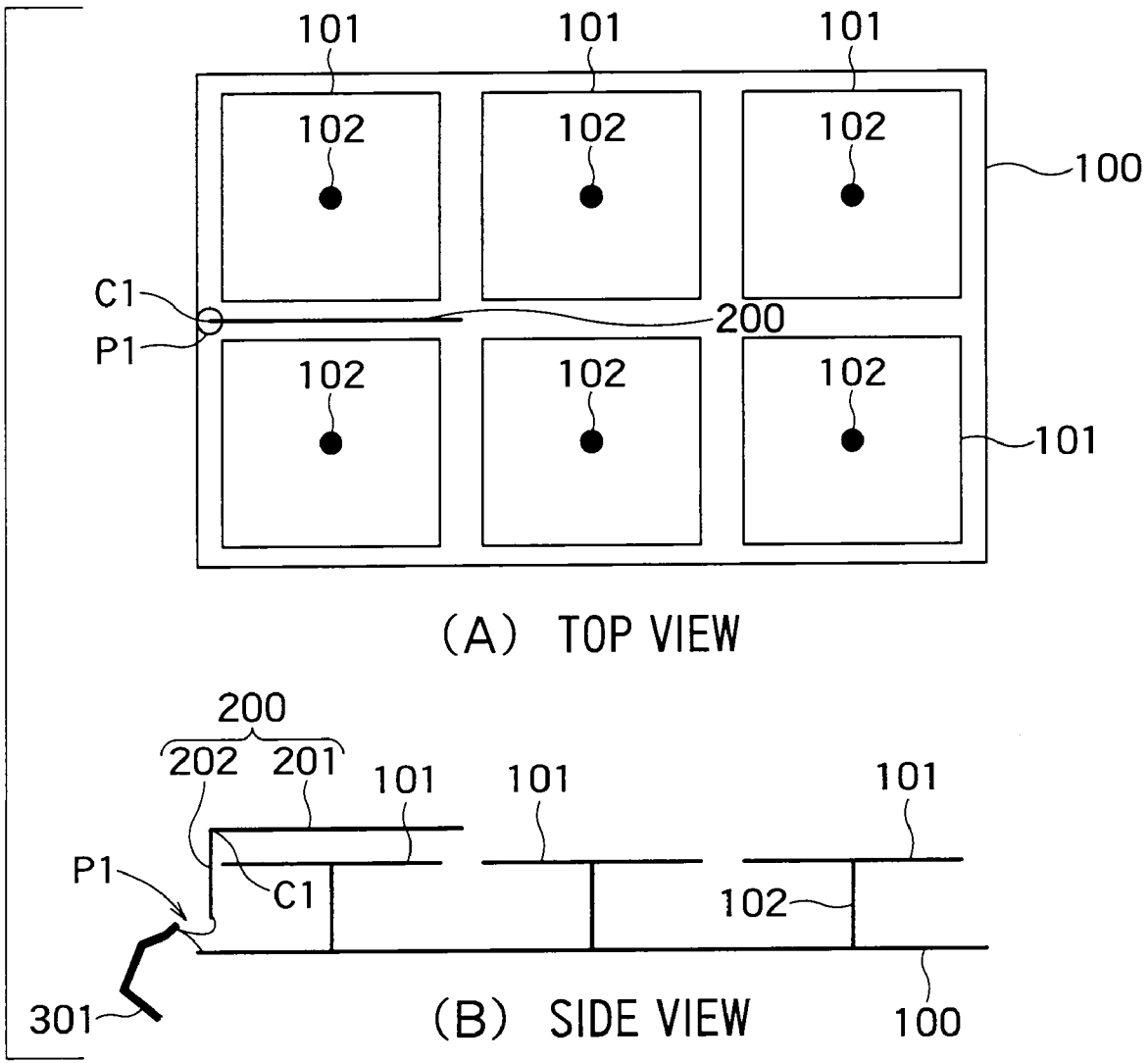
FIG. 1 shows a configuration of an antenna apparatus as a first embodiment.

FIG. 1 shows a configuration of an antenna apparatus as a first embodiment of the present invention. FIG. 1(A) is a top view and FIG. 1(B) is a side view of the antenna apparatus.

At a certain height from a finite ground plane (a ground plane) 100, planar conductive elements (first planar elements) 101 are arranged in a matrix with two rows and three columns. The matrix is not limited to having two rows and three columns and may be formed by "n" rows and "m" columns, where "n" and "m" are integers greater than 1. The planar elements 101 have a planar shape of a rectangle (herein a square), for example.

A plurality of planar elements 101 are arranged along and on both sides of a gap line that runs in a horizontal direction in the figure. That is, a plurality of planar elements 101 are arranged along and on both sides of either a first gap line or a second gap line that is orthogonal to (or intersect) the first gap line (it is assumed here they are arranged along the horizontal line, i.e., the first gap line). It is assumed that the first and second gap lines have the same width, for example. The surfaces of the planar elements 101 are approximately parallel with the ground plane 100. Each of the planar elements 101 is connected with the ground plane 100 by a linear element (a first linear element) 102 at its center. The position at which the planar element 101 is connected with the linear element 102 does not have to be the center of the planar elements 101 and may be an arbitrary position as appropriate for desired communication characteristics.

The ground plane 100, the plurality of planar elements 101, and the plurality of linear elements 102 form an EBG (Electromagnetic Band Gap) substrate.

The length "h" of the linear elements 102 is very small as compared to a operating wavelength "λ" ($h \ll \lambda$). Combination of stray capacitance between neighboring planar elements 101 and stray inductance of the linear elements 102 forms parallel resonance circuits and periodical placement of the circuits makes the entire ground plane have a high impedance.

The sum of the length of a side of the planar element 101 and the length of the linear element 102 is about a quarter of the operating wavelength. This length of a quarter wavelength means an electrical length and varies with a medium placed in the vicinity of the planar elements 101, the distance between the planar elements 101, and/or the distance between the planar elements 101 and the ground plane 100.

On such an EBG substrate, a monopole antenna 200 including a linear element 201 and a linear element 202 is placed as shown in FIG. 1(B). The monopole antenna 200 is placed such that the distance between it and the ground plane 100 is equal to or greater than the distance between the planar elements 101 and the ground plane 100.

The monopole antenna 200 has the linear element 201 which is parallel with the ground plane 100 and the linear element 202 which is approximately perpendicular to the ground plane 100, forming an approximate L-shape as a whole. The length of the monopole antenna (the sum of the lengths of the linear elements 201 and 202) is about a quarter of the operating wavelength.

The linear element 201 is placed in the first gap line described above, and one end of the linear element 202 is connected to one end of the linear element 201 and the other end of the linear element 202 faces the ground plane 100. The other end of the linear element 202 is connected to a feeding point P1 (a first feeding point).

A connection point C1 of the linear elements 201 and 202 is positioned at an intersection of the first and second gap lines. As mentioned later, the intersection of the gap lines is least affected by an induced current from the EBG substrate and therefore the connection point C1 that is closest from the feeding point P1 in the linear element 201 is positioned at the intersection having such a property, thereby minimizing degradation of antenna characteristics.

The feeding point P1 is provided in the vicinity of an edge of the ground plane 100. A feeder line 301 is connected to the feeding point P1, and a high-frequency current from a radio unit not shown is supplied to the feeding point P1 via the feeder line 301. The feeder line 301 may be a coaxial line, for example, and a coaxial line is used herein. An outer conductor of the coaxial line is connected to the ground plane 100 and an inner conductor thereof is connected to the linear element 202. The distance between the feeding point P1 and each of corners of two planar elements 101 adjacent to the feeding point P1 that are closest to the feeding point P1 is equal to or shorter than a quarter of the side of the planar element 101 in a direction parallel with the ground plane 100, for example.

Generally, in a monopole antenna, a position where radiation is caused to occur by feeding current in the ground plane, i.e., the feeding point P1 of the monopole antenna 200 in this embodiment, is placed on the edge of the ground plane 100, thereby feeding current in the periphery of the ground plane, that is, a portion in which an EBG is not formed (i.e., the edges of the ground plane 100), to cause radiation. That is, a current that leaks from the feeding point P1 into the ground plane 100 flows to the rim of the ground plane 100 and radiation due to this current takes place.

Figure 2:
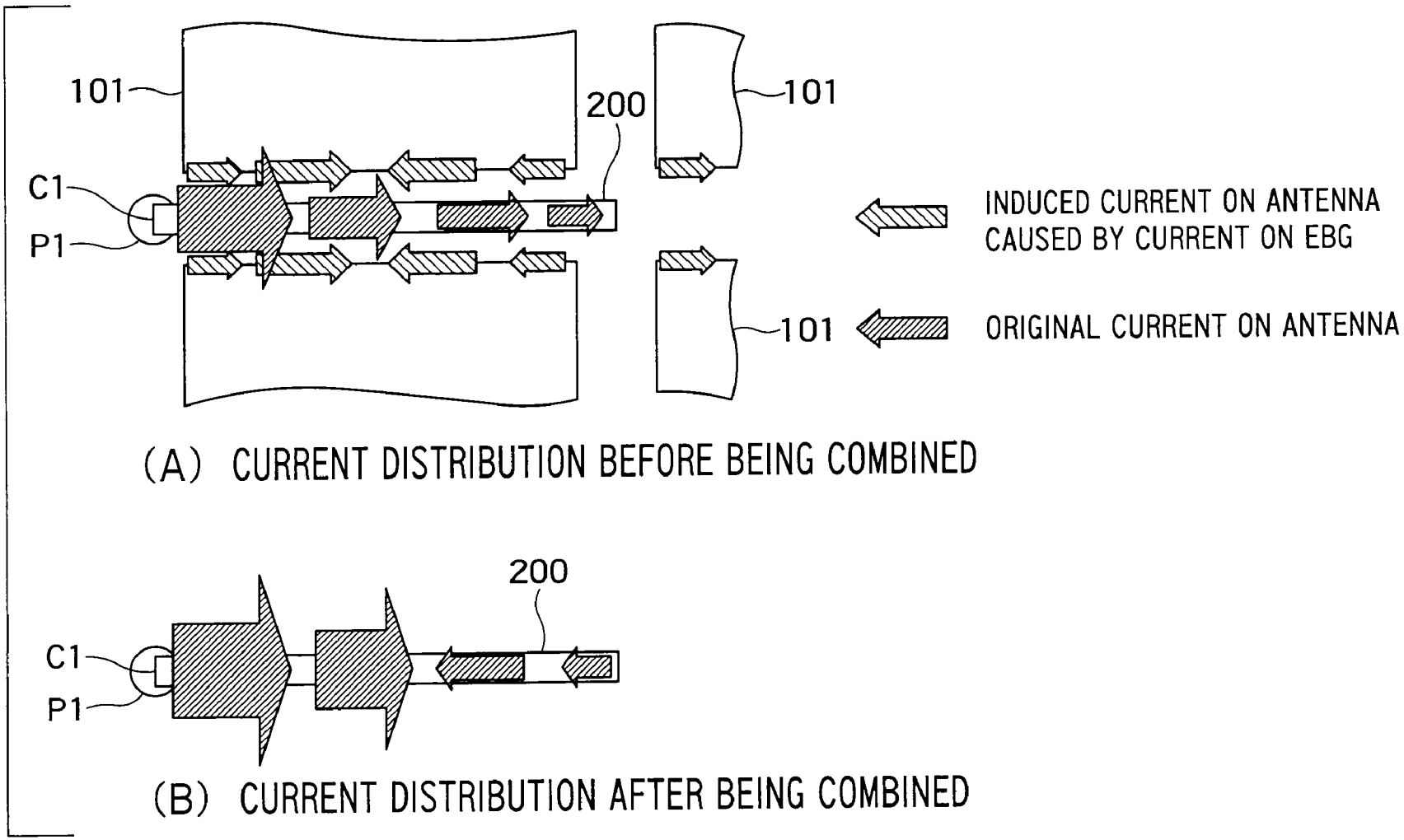
FIG. 2 illustrates current distribution on a monopole antenna of FIG. 1.

FIG. 2 illustrates current distribution on the monopole antenna of FIG. 1.

FIG. 2(A) separately illustrates an induced current that is generated on the monopole antenna due to the current on the EBG substrate and a current that originally exists on the monopole antenna. FIG. 2(B) shows a combined current as the sum of those currents (a current that actually flows in the monopole antenna).

It is understood that as compared with the example of FIG. 13, the difference between the current that originally exists in the monopole antenna 200 and the combined current is small in the vicinity of the connection point C1. The reason for this is described below.

The current on the EBG substrate assumes a sinusoidal distribution on one planar element 101 from one of its vertices (or corners) to a neighboring vertex via the connection point with the linear element 102. Therefore, the current is largest at the point where the planar element 101 is connected with the linear element 102 and smallest at each vertex (see FIG. 12). Thus, when the connection point C1 is positioned at a point where vertices of planar elements 101 meet (the intersection of the first and second gap lines), an induced current that is generated at the connection point C1 becomes small and change of current caused by the EBG substrate is reduced. That is to say, in the monopole antenna 200, the linear element 201 is susceptible to the effect of current on the EBG substrate, and particularly the connection point C1 that is closest to the feeding point P1 in the linear element 201 is positioned at the intersection that is least affected by the induced current, thereby minimizing the degradation of antenna characteristics caused by the induced current.

In this manner, this embodiment suppresses degradation of matching characteristics by positioning the monopole antenna such that the connection point C1 is positioned at a point where vertices of planar elements 101 meet (the intersection of the first and second gap lines) while enabling the monopole antenna 200 and the EBG substrate to be close to each other, which can reduce the thickness of the antenna apparatus. Of course, generation of an unnecessary image current on the ground plane 100 is suppressed by the effects of the EBG substrate, and resulting effects of improved antenna gain and facility of matching can be obtained as in conventional practices.

While this embodiment positions the connection point C1 at the intersection of the gap line in which the monopole antenna is placed (i.e., the first gap line) and the second gap line which is orthogonal to the first gap line and which has no planar elements on one side, effects of induced current can be also suppressed when the connection point C1 is positioned at the intersection of the first gap line and the second gap line that has planar elements on both sides. However, such a configuration has a disadvantage of radio wave radiation from the ground plane being suppressed.

Second Embodiment

Figure 3:
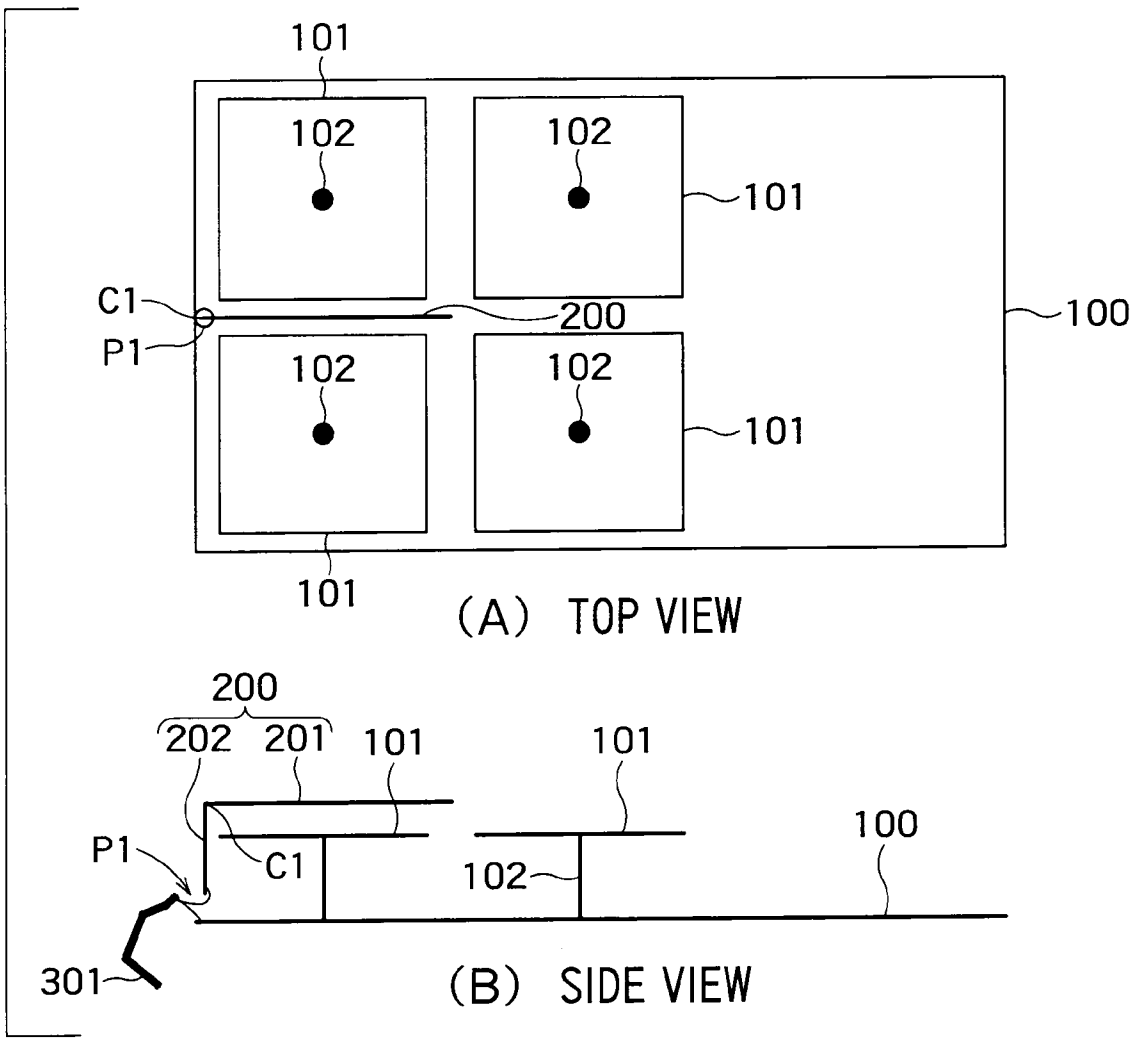
FIG. 3 shows a configuration of the antenna apparatus as a second embodiment.

FIG. 3 shows a configuration of an antenna apparatus as a second embodiment of the present invention. FIG. 3(A) is a top view and FIG. 3(B) is a side view of the antenna apparatus.

A difference of this embodiment from the first embodiment is that there is an area in which no planar elements are present (or an unoccupied area) in the right-hand part of the ground plane 100. In other words, on the ground plane 100, no planar elements are arranged on the side of an edge (a second edge) that is on the opposite side to the edge (a first edge) that is close to the feeding point P1.

In addition, as in the first embodiment, the periphery of the ground plane 100 serves as a path of current from the feeding point P1 and this embodiment feeds the current that flows in this periphery of the ground plane 100 into the unoccupied area so as to cause radiation also from the area.

Figure 4:
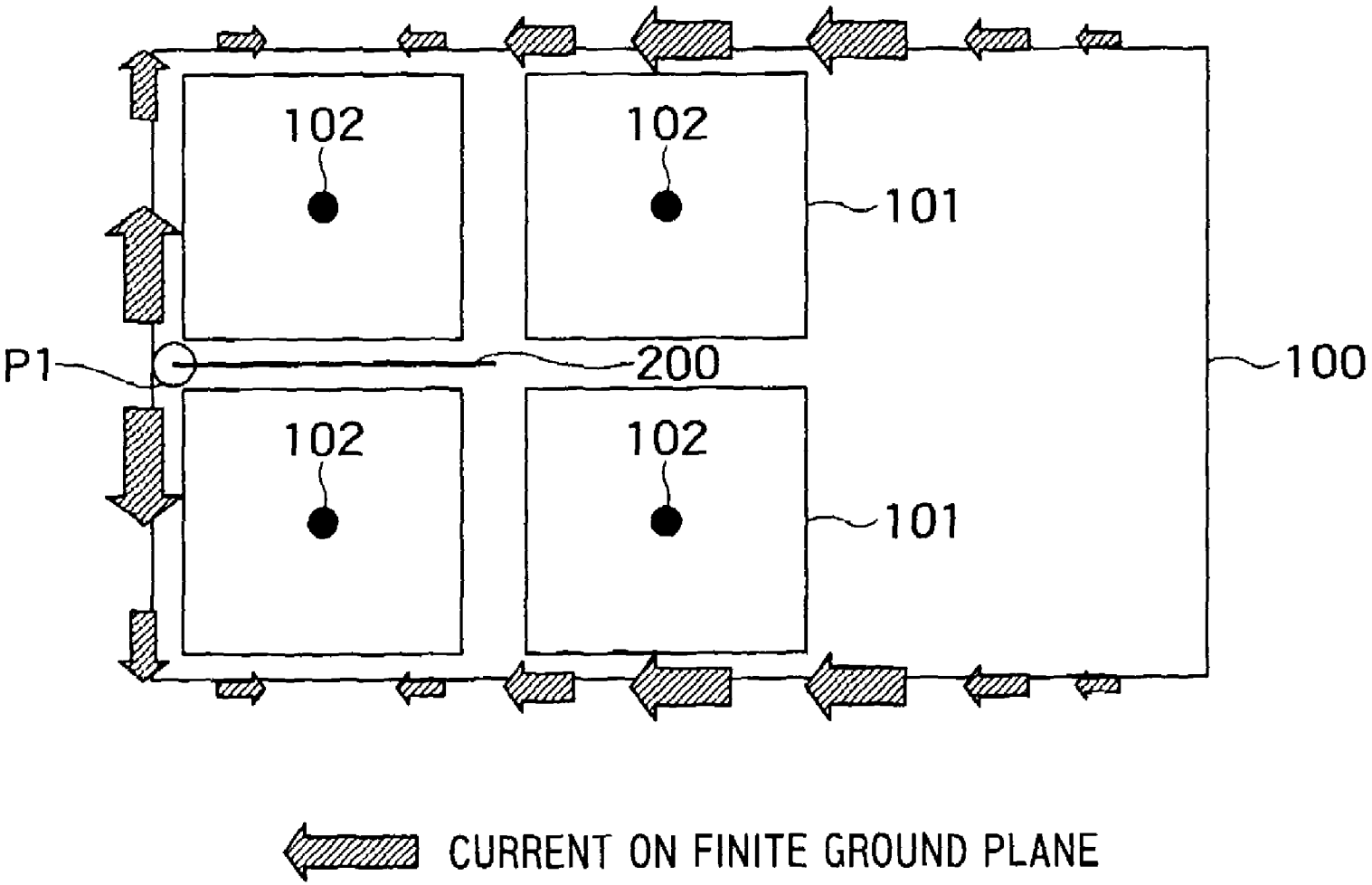
FIG. 4 schematically illustrates current that leaks from the monopole antenna into a finite ground plane in the antenna apparatus of FIG. 3.

FIG. 4 schematically shows current that leaks from the monopole antenna 200 into the ground plane 100. The current that has leaked from the feeding point P1 to the ground plane 100 flows into the unoccupied area, the rim of the unoccupied area in particular, via the rim or periphery of the ground plane 100, and radiation occurs also from the area, which further improves antenna gain. Even when planar elements are placed in the unoccupied area, antenna gain can be still improved by feeding current into the rim of the unoccupied area.

Third Embodiment

Figure 5:
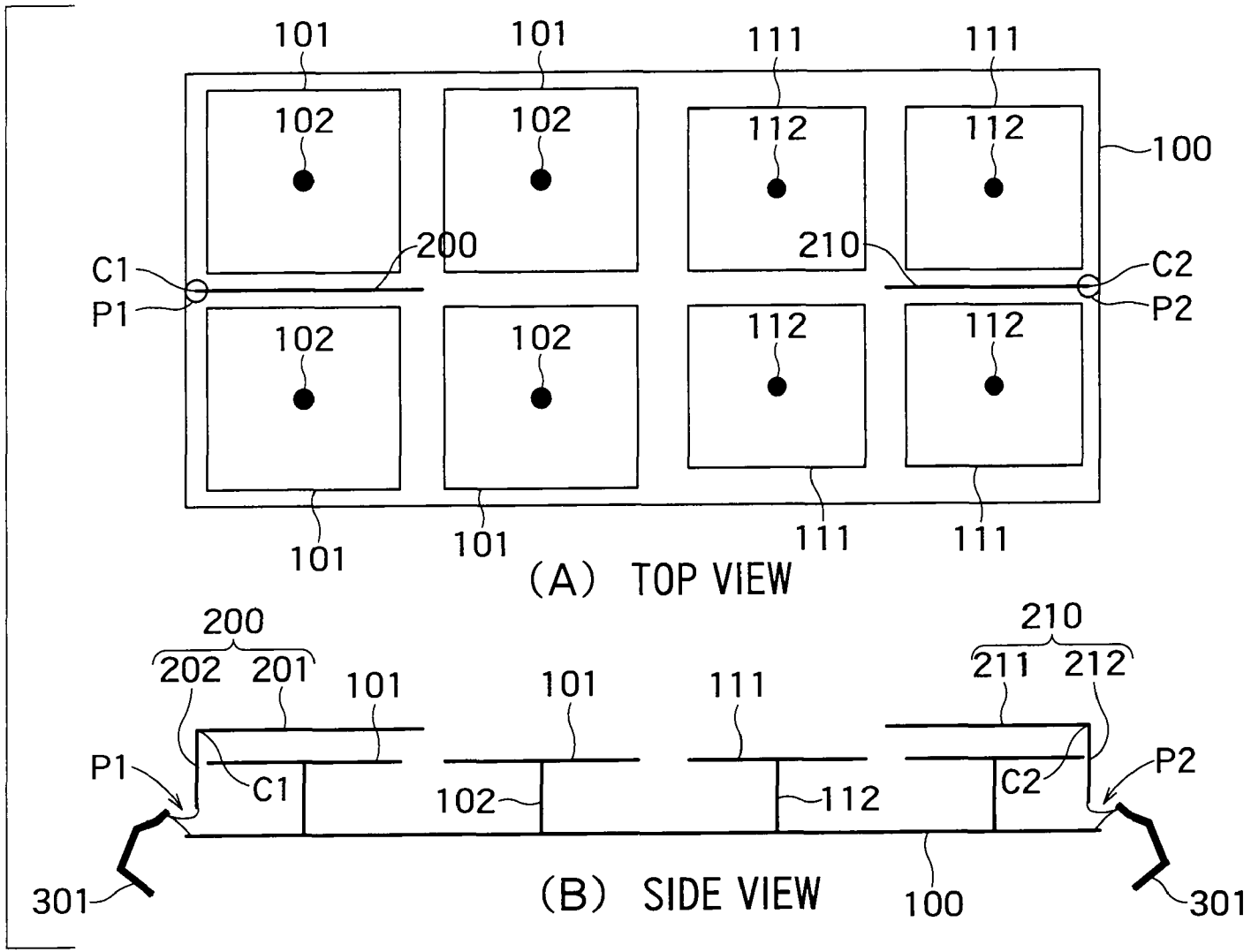
FIG. 5 shows a configuration of the antenna apparatus as a third embodiment.

FIG. 5 shows a configuration of an antenna apparatus as a third embodiment of the present invention.

EBG configurations and monopole antennas that correspond to two different frequencies are arranged on the ground plane 100. That is to say, an EBG configuration that includes a plurality of planar elements (second planar elements) 111, a plurality of linear elements (fourth linear elements) 112 and the ground plane 100 is further added to the antenna apparatus of the second embodiment (see FIG. 3). For this new EBG configuration, a monopole antenna 210 including linear elements 211 and 212, and a feeding point P2 are added.

More specifically, a plurality of planar elements 111 are arranged along and on both sides of a third gap line or a fourth gap line that is orthogonal to the third gap line in an area that is different from the area in which the plurality of planar elements 101 are arranged. The plurality of planar elements 111 are connected with the ground plane 100 via a plurality of linear elements (fourth linear elements) 112.

The linear element 211 (a fifth linear element) is placed in the third or fourth gap line, and the linear element 212 (a sixth linear element) is placed such that one end thereof is connected to one end of the linear element 211 and the other end thereof faces the ground plane 100. These linear elements 211 and 212 form the monopole antenna 210 (a second antenna element). A feeding point P2 is connected to the other end of the linear element 212 and the feeding point P2 is provided on an edge that is on the opposite side to the edge on which the feeding point P1 is present. A connection point C2 of the linear elements 212 and 211 is positioned at an intersection of the third and fourth gap lines.

The other end (an open end) of the linear element 201 and the other end (an open end) of the linear element 211 face each other.

The size and placement pitch of the planar elements 101 are different from those of the planar elements 111, and the length of the monopole antenna 200 is different from that of the monopole antenna 210.

The two EBG configurations have different frequency selectivity (or have different operation frequencies) and one of the EBG configurations is equivalent to non-existence from the viewpoint of the other one. Therefore, the radiation characteristics of the two monopole antennas are improved as compared to the first embodiment for similar reasons to the second embodiment.

Fourth Embodiment

Figure 6:
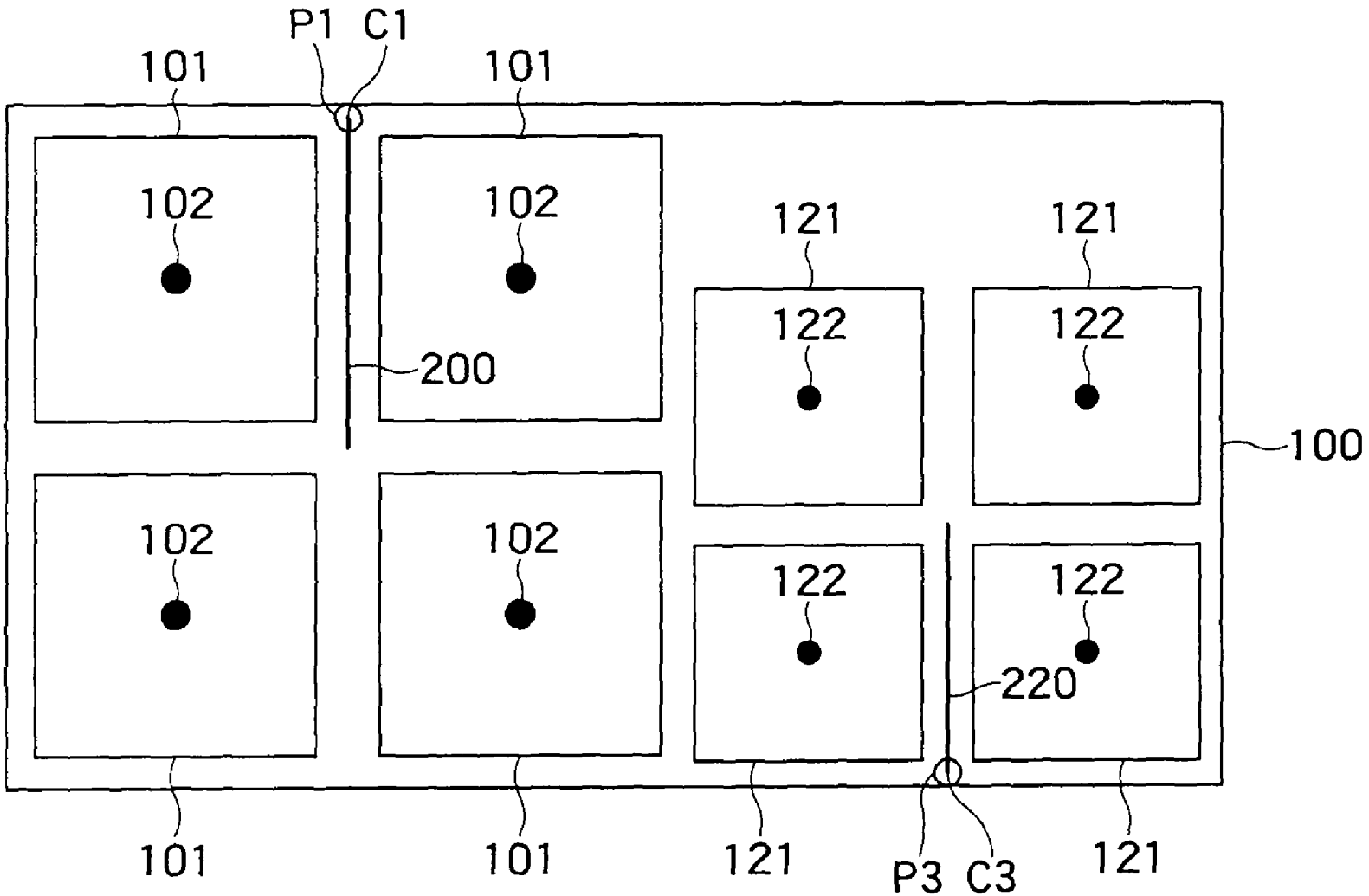
FIG. 6 shows a configuration of the antenna apparatus as a fourth embodiment.

FIG. 6 shows a configuration of an antenna apparatus as a fourth embodiment of the present invention.

This embodiment also further adds an EBG configuration, a monopole antenna and a feeding point to the second embodiment like the third embodiment, but the way of adding them is different from the third embodiment. However, while the second embodiment provides the monopole antenna 200 in the horizontal gap line, this embodiment provides it in the vertical gap line and the feeding point P1 is accordingly placed on an upper edge of the ground plane 100.

A plurality of planar elements (third planar elements) 121 are arranged along and on both sides of either a fifth gap line or a sixth gap line that is orthogonal to the fifth gap line in an area that is different from the area in which the plurality of planar elements 101 are arranged. The plurality of planar elements 121 are connected with the ground plane 100 via a plurality of linear elements (seventh linear elements) 122.

A linear element (an eighth linear element) is placed in the fifth or sixth gap line, and another linear element (a ninth linear element) is placed such that one end thereof is connected to one end of the eighth linear element and the other end thereof faces the ground plane 100. These eighth and ninth linear elements form a monopole antenna 220 (a third antenna element). A feeding point P3 is connected to the other end of the ninth linear element and the feeding point P3 is provided on an edge that is on the opposite side to the edge on which the feeding point P1 is present. A connection point C3 of the eighth and ninth linear elements is positioned at an intersection of the fifth and sixth gap lines.

The monopole antennas 200 and 220 are parallel with each other and an open end of the monopole antenna 200 (i.e., the other end of the linear element 201) is oriented in a direction opposite to the open end of the monopole antenna 220 (i.e., the other end of the eighth linear element).

The size and placement pitch of the planar elements 101 are different from those of the planar elements 121, and the length of the monopole antenna 200 is different from that of the monopole antenna 220.

Although this embodiment provides less effect of gain improvement than the third embodiment, coupling between the antennas becomes small because the ends (open ends) of the monopole antennas do not face each other. This embodiment is therefore suitable for use when suppression of interference between the antennas is required.

Fifth Embodiment

Figure 7:
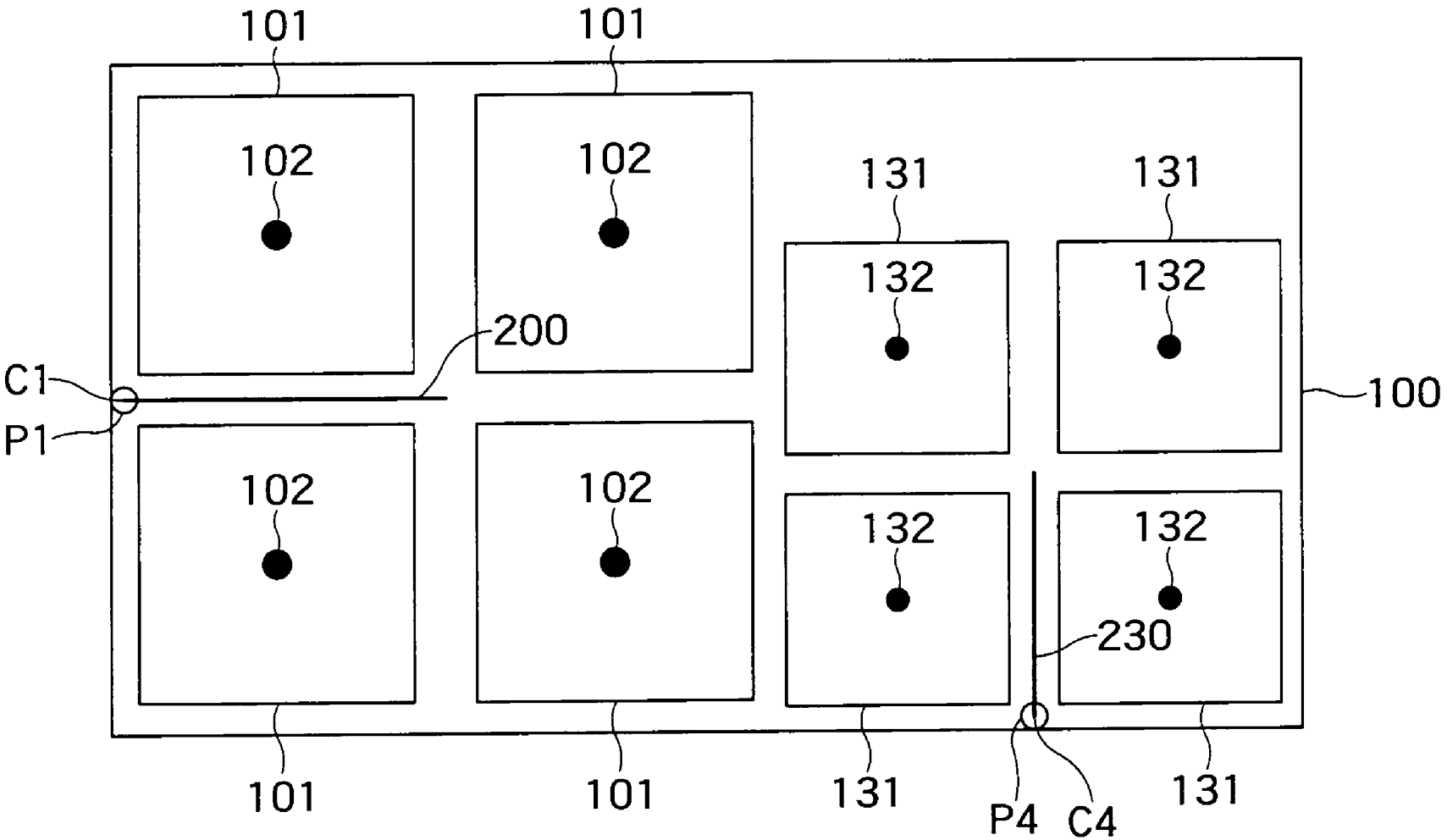
FIG. 7 shows a configuration of the antenna apparatus as a fifth embodiment.

FIG. 7 shows a configuration of an antenna apparatus as a fifth embodiment of the present invention.

This embodiment also further adds an EBG configuration, a monopole antenna and a feeding point to the second embodiment like the third embodiment, but the way of adding them is different from the third embodiment.

A plurality of planar elements (fourth planar elements) 131 are arranged along and on both sides of either a seventh gap line or an eighth gap line that is orthogonal to the seventh gap line in an area that is different from the area in which the plurality of planar elements 101 are arranged. The plurality of planar elements 131 are connected with the ground plane 100 via a plurality of linear elements (tenth linear elements) 132.

A linear element (an eleventh linear element) is placed in the seventh or eighth gap line, and another linear element (a twelfth linear element) is placed such that one end thereof is connected to one end of the eleventh linear element and the other end thereof faces the ground plane 100. These eleventh and twelfth linear elements form a monopole antenna 230 (a fourth antenna element). A feeding point P4 is connected to the other end of the twelfth linear element and the feeding point P4 is provided on an edge that adjoins the edge on which the feeding point P1 is present. A connection point C4 of the eleventh and twelfth linear elements is positioned at an intersection of the seventh and eighth gap lines.

The direction in which the open end of the monopole antenna 200 (i.e., the other end of the linear element 201) is oriented is approximately orthogonal to the direction in which the open end of the monopole antenna 230 (the other end of the eleventh linear element) is oriented.

The size and placement pitch of the planar elements 101 are different from those of the planar elements 131, and the length of the monopole antenna 200 is different from that of the monopole antenna 230.

This embodiment also suppresses interference between the antennas as in the fourth embodiment because the ends (open ends) of the two monopole antennas are not oriented in the same direction (in the present example, they are orthogonal).

In addition, in this embodiment, current that has leaked from the monopole antenna 200 flows into the area in which the planar elements 131 are arranged (especially the edges of the ground plane 100) and radiation occurs also from this area as in the second embodiment. Thus, as for the monopole antenna 200, gain can be improved more than in the first embodiment.

Sixth Embodiment

Figure 8:
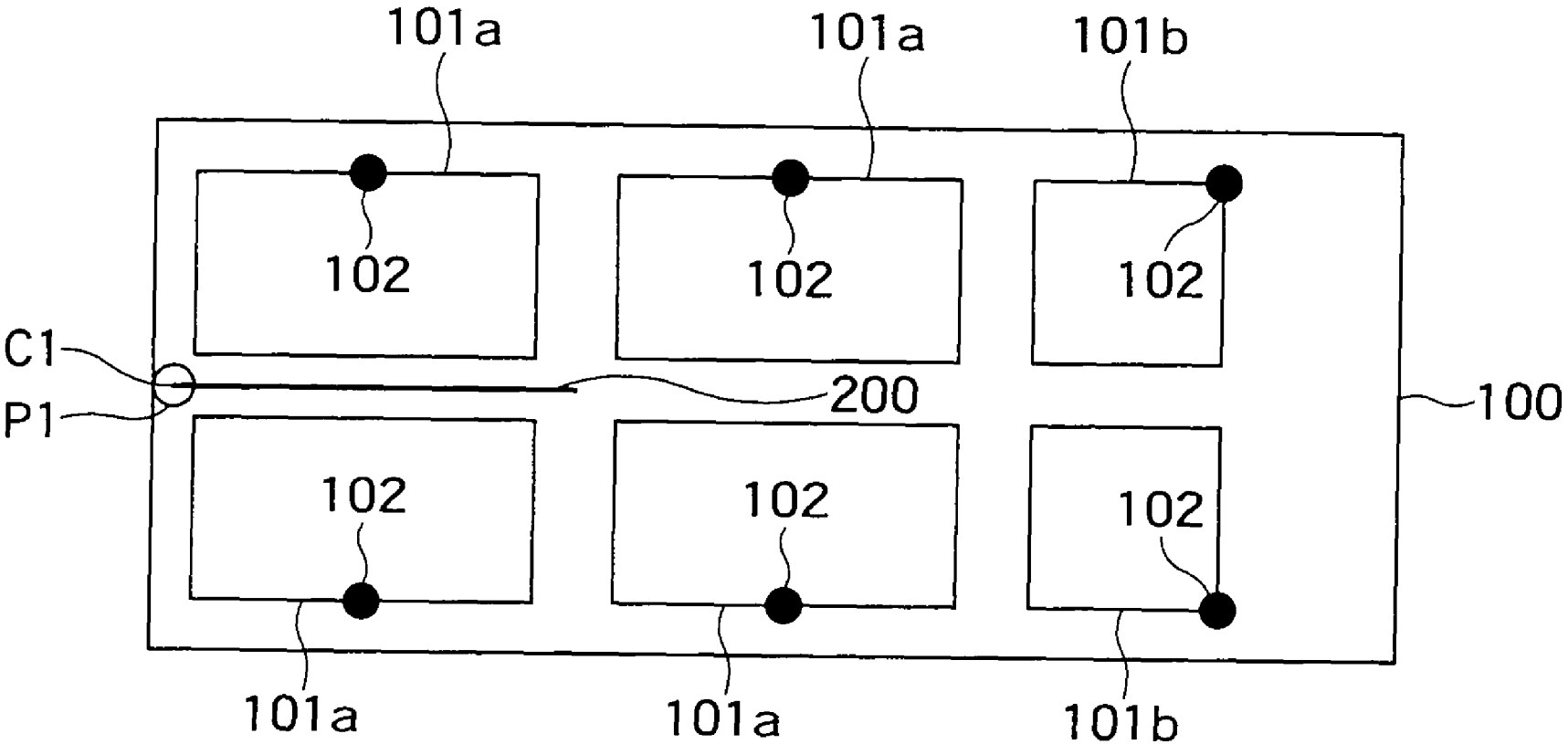
FIG. 8 shows a configuration of the antenna apparatus as a sixth embodiment.

FIG. 8 shows a configuration of an antenna apparatus as a sixth embodiment of the present invention.

In this embodiment, any side of a planar element of the first embodiment (see FIG. 1) that has no neighboring planar element is trimmed in half. Consequently, in the figure, a planar element 101*a* has an area equal to half that of the planar element 101 of the first embodiment and a planar element 101*b* has an area equal to a quarter of that of the planar element 101. The planar elements 101*a* and 101*b* are connected with the ground plane 100 via the linear element 102 on their edge. That is, planar elements that are positioned outermost among a number of planar elements are connected with the ground plane on their edge via the linear element.

The EBG substrate operates by parallel resonance caused by capacitance that is generated in gaps between planar elements, and inductance of linear elements that short planar elements, and planar elements. Accordingly, a portion on a side that has no neighboring planar element from the viewpoint of the connection point of the linear element 102 with a planar element does not contribute to operation. Thus, removal of such a portion can reduce the size of the apparatus.

In this manner, this embodiment can realize similar effects to the first embodiment while enabling size reduction of the ground plane and therefore that of the antenna apparatus.

Seventh Embodiment

Figure 9:
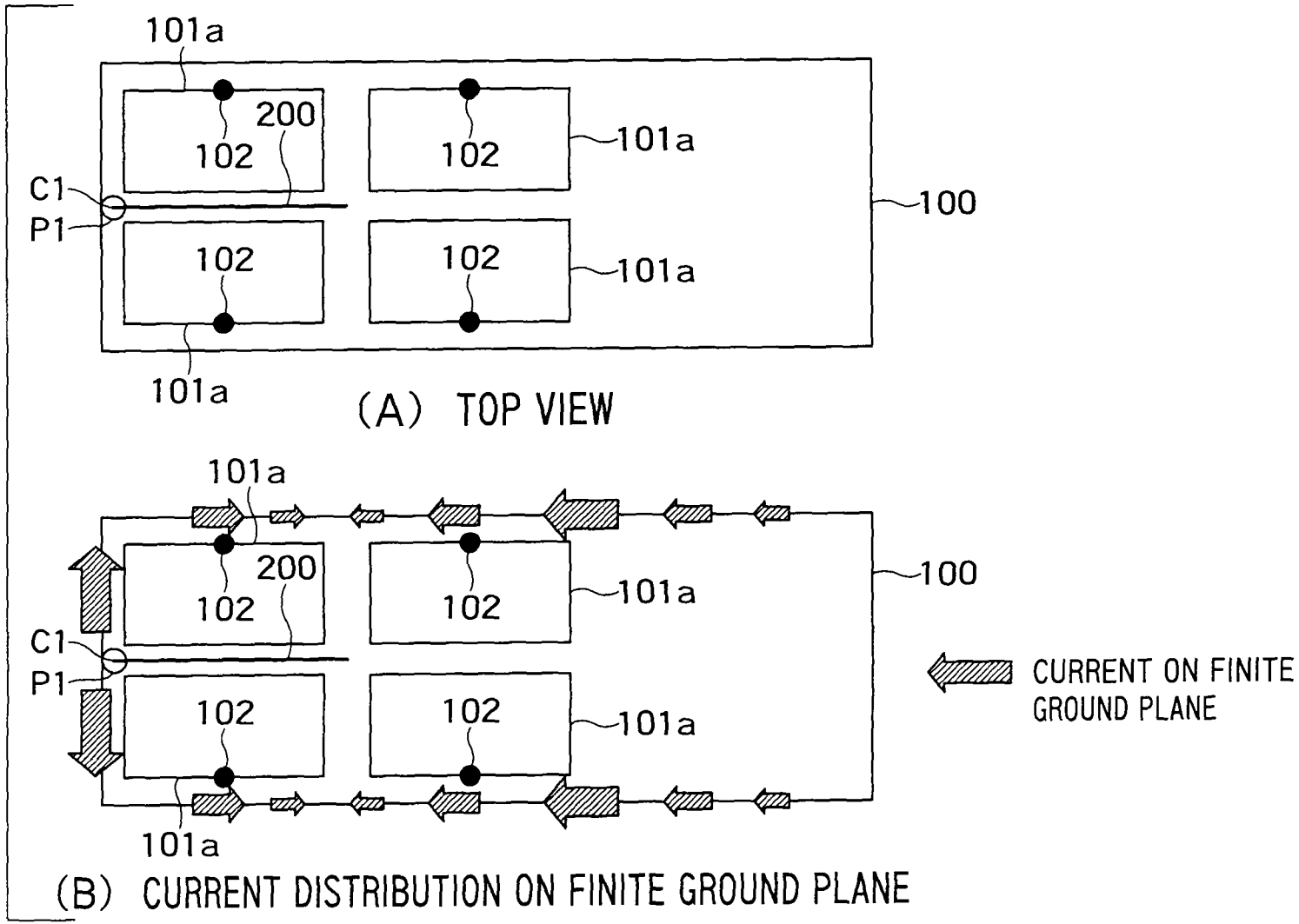
FIG. 9 shows a configuration of the antenna apparatus as a seventh embodiment.

FIG. 9(A) shows a configuration of an antenna apparatus as a seventh embodiment of the present invention.

In this embodiment, any side of a planar element of the second embodiment (see FIG. 3) that has no neighboring planar element is trimmed in half. The concept of this embodiment is similar to the sixth embodiment. As shown in FIG. 9(B), which schematically illustrates current leaking from the monopole antenna 200 into the ground plane 100, this embodiment can provide effects similar to the second embodiment while enabling size reduction of the ground plane 100 and therefore that of the antenna apparatus.

Eighth Embodiment

Figure 10:
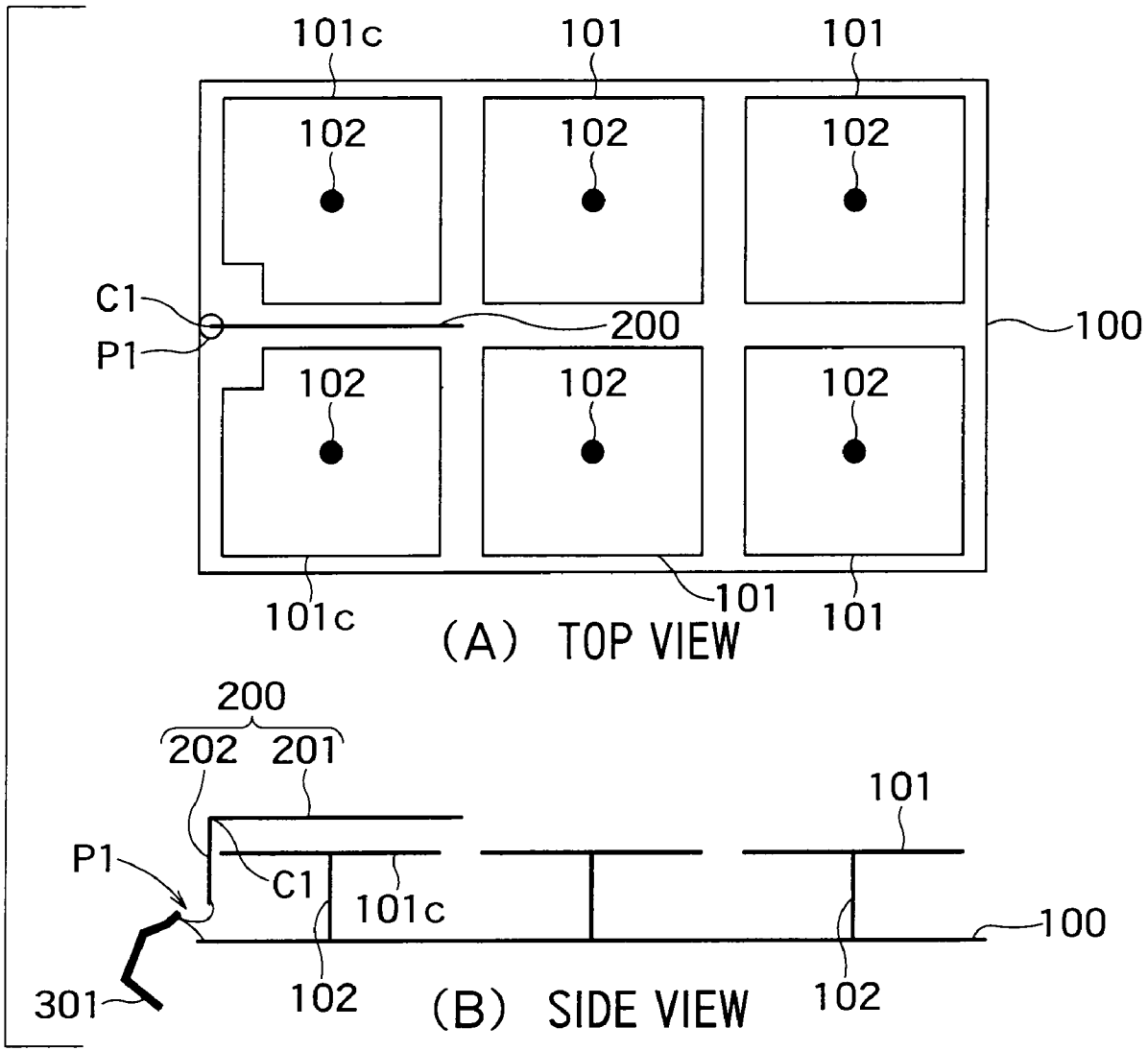
FIG. 10 shows a configuration of the antenna apparatus as an eighth embodiment.

FIG. 10 shows a configuration of an antenna apparatus as an eighth embodiment of the present invention.

In this antenna apparatus, a notch is provided at a corner of a planar element which is close to the feeding point P1 among the planar elements on the EBG substrate of the first embodiment. More specifically, in a planar element that is closest to the feeding point P1, a notch is provided at one corner thereof that is closest to the feeding point P1. Such provision of the notch facilitates the placement of the monopole antenna 200.

The notch of the planar element 101*c* has such a size that does not affect the high-impedance characteristics of the EBG substrate, e.g., a size that fits in a square whose side is equal to a quarter of the side of the planar element 101.

As compared to such a configuration as shown in FIG. 14 in which one planar element is removed and a monopole antenna is placed there, this embodiment has a high effect of suppressing unnecessary image current on the ground plane 100 and can shorten the distance between the monopole antenna and the EBG more than the configuration of FIG. 14.

The notch of a planar element in this embodiment can also be applied to the second to seventh embodiments.

Ninth Embodiment

Figure 11:
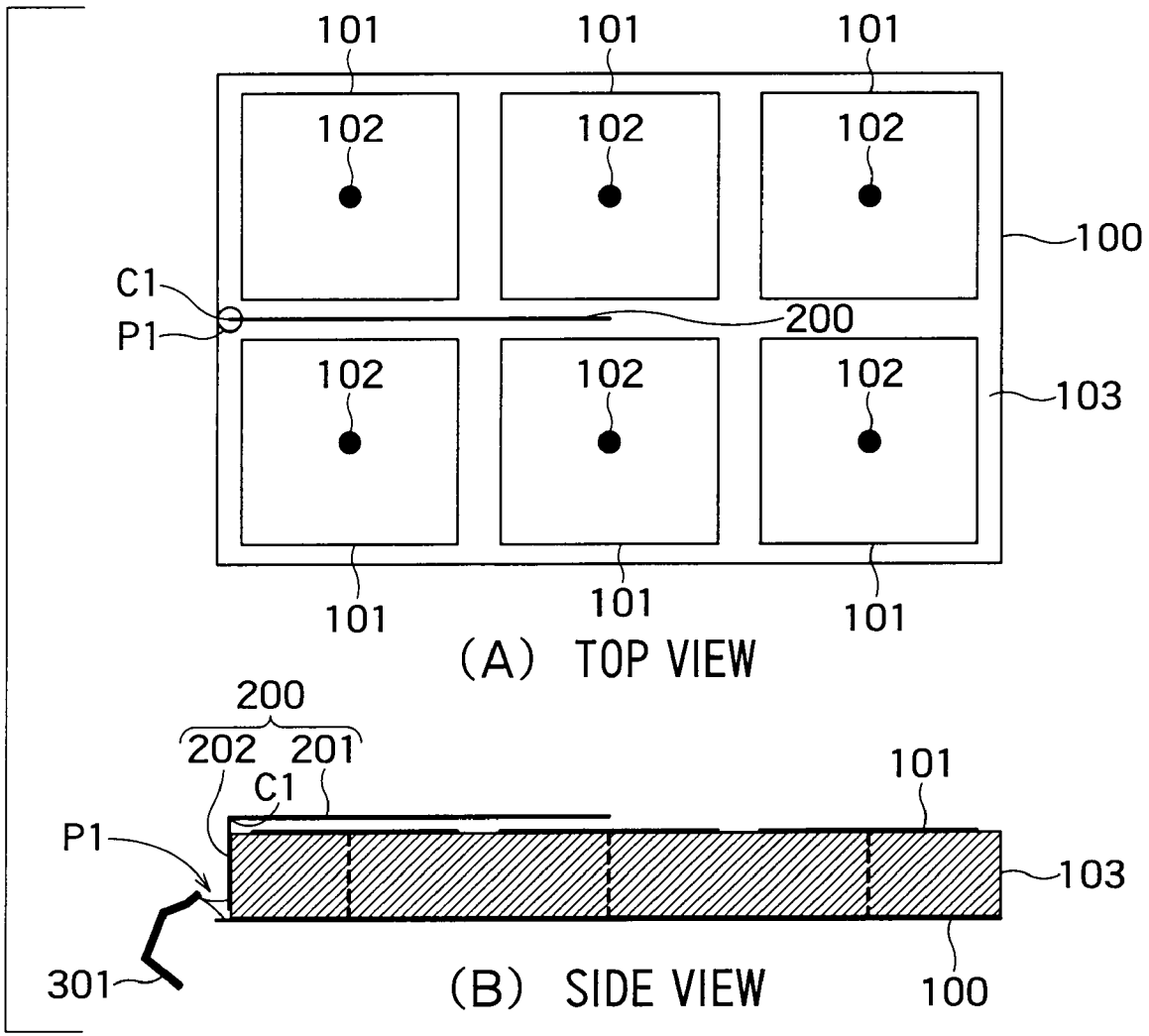
FIG. 11 shows a configuration of the antenna apparatus as a ninth embodiment.

FIG. 11 shows a configuration of an antenna apparatus as a ninth embodiment of the present invention. FIG. 11(A) is a top view and FIG. 11(B) is a side view of the antenna apparatus.

In this embodiment, an insulator substrate 103 which supports the planar elements 101 is provided between the planar elements 101 and the ground plane 100 in the antenna apparatus of the first embodiment. The insulator substrate 103 is formed of a material having a dielectric constant different from that of air, and an effect of wavelength shortening by the dielectric constant of the insulator enables the planar elements 101 to be reduced in size and the EBG substrate in thickness.

The linear element 201 of the monopole antenna 200 is provided on a surface of the insulator substrate 103 and the linear element 202 is in contact with a side surface of the insulator substrate 103. However, for the sake of clarity, FIG. 11(B) depicts the linear element 201 somewhat away from the surface of the insulator substrate 103. The linear element 102 is connected with the ground plane 100 through the insulator substrate 103.

By arranging the linear element 201 and the planar elements 101 on the surface of the insulator substrate 103, it is easy to configure the linear element 201 and the planar elements 101 on the same plane. In this case, due to the wavelength shortening effect, the sum of the lengths of the linear elements 201 and 202 can be made short as compared to a case without the insulator substrate 103.

This embodiment can also provide similar effects to the first embodiment in addition to the effect mentioned above. The insulator substrate may be provided in a similar manner in the second to eighth embodiments as well.

While the present invention has been described above with respect to the embodiments thereof, the invention is also applicable to wireless communication typified by wireless terminals such as mobile phones and personal computers using a wireless LAN (Local Area Network), an antenna for receiving terrestrial digital broadcasting, or other antenna for radar. It is especially suitable for an antenna that is mounted on a surface of a mobile object which requires reduction of thickness.

The present invention is not limited to the exact embodiments described above and can be embodied with its components modified in an implementation phase without departing from the scope of the invention. Also, arbitrary combinations of the components disclosed in the above-described embodiments can form various inventions. For example, some of the all components shown in the embodiments may be omitted. Furthermore, components from different embodiments may be combined as appropriate.

What is claimed is:

1. An antenna apparatus, comprising:

a finite ground plane;

a plurality of first planar elements arranged along and on both sides of a first gap line and a second gap line that is orthogonal to the first gap line;

a plurality of first linear elements to connect the finite ground plane with each of the first planar elements;

an antenna element including a second linear element placed in the first gap line and a third linear element placed such that one end of the third linear element is connected to one end of the second linear element and an other end of the third linear element faces the finite ground plane;

a first feeding point to supply electric power to the antenna element from the other end of the third linear element;

a plurality of second planar elements arranged along and on both sides of a third gap line and a fourth gap line that is orthogonal to the third gap line in a different area from an area in which the first planar elements are arranged;

a plurality of fourth linear elements to connect the finite ground plane with each of the second planar elements;

a second antenna element including a fifth linear element placed in the third gap line and a sixth linear element placed such that one end of the sixth linear element is connected to one end of the fifth linear element and the other end of the sixth linear element faces the finite ground plane; and a second feeding point to supply electric power to the second antenna element from the other end of the sixth linear element, wherein a connection point of the second linear element with the third linear element is positioned in an intersection area of the first gap line and the second gap line, the first feeding point is provided in a vicinity of an edge of the finite ground plane, a connection point of the fifth linear element with the sixth linear element is positioned in an intersection area of the third gap line and the fourth gap line, the other end of the second linear element and the other end of the fifth linear element face each other, and the second feeding point is provided in a vicinity of an edge on an opposite side to an edge on which the first feeding point is provided.

2. The apparatus according to claim 1, wherein outer planar elements that are positioned outermost among the first planar elements are connected with the finite ground plane via the first linear elements on edges of the outer planar elements.

3. The apparatus according to claim 1, wherein the first planar elements have a planar shape of a rectangle, respectively, and ones of the first planar elements that are close to the intersection area of the first and second gap lines have a notch in a corner thereof that is closest to the intersection area, respectively.

4. The apparatus according to claim 1, further comprising an insulator substrate that is formed of a material having a different dielectric constant from a dielectric constant of air between the first planar elements and the finite ground plane.

5. An antenna apparatus, comprising:

a finite ground plane;

a plurality of first planar elements arranged along and on both sides of a first gap line and a second gap line that is orthogonal to the first gap line;

a plurality of first linear elements to connect the finite ground plane with each of the first planar elements;

an antenna element including a second linear element placed in the first gap line and a third linear element placed such that one end of the third linear element is connected to one end of the second linear element and an other end of the third linear element faces the finite ground plane;

a first feeding point to supply electric power to the antenna element from the other end of the third linear element;

a plurality of second planar elements arranged along and on both sides of a third gap line and a fourth gap line that is orthogonal to the third gap line in a different area from an area in which the first planar elements are arranged;

a plurality of fourth linear elements to connect the finite ground plane with each of the second planar elements;

a second antenna element including a fifth linear element placed in the third gap line and a sixth linear element placed such that one end of the sixth linear element is connected to one end of the fifth linear element and the other end of the sixth linear element faces the finite ground plane; and a second feeding point to supply electric power to the second antenna element from the other end of the sixth linear element, wherein a connection point of the second linear element with the third linear element is positioned in an intersection area of the first gap line and the second gap line, the first feeding point is provided in a vicinity of an edge of the finite ground plane, a connection point of the fifth linear element with the sixth linear element is positioned in an intersection area of the third gap line and the fourth gap line, the second linear element and the fifth linear element are parallel with each other, the other end of the second linear element is oriented in a direction opposites to the other end of the fifth linear element, and the second feeding point is provided in a vicinity of an edge on an opposite side to an edge on which the first feeding point is provided.

6. The apparatus according to claim 5, wherein outer planar elements that are positioned outermost among the first planar elements are connected with the finite ground plane via the first linear elements on edges of the outer planar elements.

7. The apparatus according to claim 5, wherein the first planar elements have a planar shape of a rectangle, respectively, and ones of the first planar elements that are close to the intersection area of the first and second gap lines have a notch in a corner thereof that is closest to the intersection area, respectively.

8. The apparatus according to claim 5, further comprising an insulator substrate that is formed of a material having a different dielectric constant from a dielectric constant of air between the first planar elements and the finite ground plane.

9. An antenna apparatus, comprising:

a finite ground plane;

a plurality of first planar elements arranged along and on both sides of a first gap line and a second gap line that is orthogonal to the first gap line;

a plurality of first linear elements to connect the finite ground plane with each of the first planar elements;

an antenna element including a second linear element placed in the first gap line and a third linear element placed such that one end of the third linear element is connected to one end of the second linear element and an other end of the third linear element faces the finite ground plane;

a first feeding point to supply electric power to the antenna element from the other end of the third linear element;

a plurality of second planar elements arranged along and on both sides of a third gap line and a fourth gap line that is orthogonal to the third gap line in a different area from an area in which the first planar elements are arranged;

a plurality of fourth linear elements to connect the finite ground plane with each of the second planar elements;

a second antenna element including a fifth linear element placed in the third gap line and a sixth linear element placed such that one end of the sixth linear element is connected to one end of the fifth linear element and the other end of the sixth linear element faces the finite ground plane; and a second feeding point to supply electric power to the second antenna element from the other end of the sixth linear element, wherein a connection point of the second linear element with the third linear element is positioned in an intersection area of the first gap line and the second gap line, the first feeding point is provided in a vicinity of an edge of the finite ground plane, a connection point of the fifth linear element with the sixth linear element is positioned in an intersection area of the third gap line and the fourth gap line, a direction in which the other end of the second linear element is oriented is approximately orthogonal to a direction in which the other end of the fifth linear element is oriented, and the second feeding point is provided in a vicinity of an edge that adjoins the edge on which the first feeding point is provided.

10. The apparatus according to claim 9, wherein outer planar elements that are positioned outermost among the first planar elements are connected with the finite ground plane via the first linear elements on edges of the outer planar elements.

11. The apparatus according to claim 9, wherein the first planar elements have a planar shape of a rectangle, respectively, and ones of the first planar elements that are close to the intersection area of the first and second gap lines have a notch in a corner thereof that is closest to the intersection area, respectively.

12. The apparatus according to claim 9, further comprising an insulator substrate that is formed of a material having a different dielectric constant from a dielectric constant of air between the first planar elements and the finite ground plane.

* * * * *